US007066166B2

(12) United States Patent
Crites, Jr. et al.

(10) Patent No.: US 7,066,166 B2
(45) Date of Patent: Jun. 27, 2006

(54) KWICK-COCK

(76) Inventors: Will Lee Crites, Jr., 14325 W. 89th. St., Lenexa, KS (US) 66215; John Blair Weiss, 23339 Victory Rd., Spring Hill, KS (US) 66083

( * ) Notice: Subject to any disclaimer, the term of this patent is extended or adjusted under 35 U.S.C. 154(b) by 0 days.

(21) Appl. No.: 10/942,282

(22) Filed: Sep. 16, 2004

(65) Prior Publication Data

US 2005/0076894 A1 Apr. 14, 2005

Related U.S. Application Data

(60) Provisional application No. 60/510,583, filed on Oct. 14, 2003.

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS

| | | | | |
|---|---|---|---|---|
| 3,670,711 | A * | 6/1972 | Firestone | 124/25 |
| 4,649,892 | A * | 3/1987 | Bozek | 124/25 |
| 4,719,897 | A * | 1/1988 | Gaudreau | 124/25 |
| 4,827,894 | A * | 5/1989 | Schallberger | 124/25 |
| 4,942,861 | A * | 7/1990 | Bozek | 124/25 |
| 5,115,795 | A * | 5/1992 | Farris | 124/86 |
| 5,215,069 | A * | 6/1993 | Liu | 124/25 |

* cited by examiner

*Primary Examiner*—John A. Ricci

(57) ABSTRACT

A crossbow bowstring drawing device which can be operated in two seconds, has one moving part, and is relatively simple and inexpensive to make. It reduces the necessary applied force so that any adult with normal motion capability can operate it. The basis for the device is a curved lever unit, appropriately curved to provide a pulling force on the bowstring as the lever is pulled up and back. The pivot point for the lever can be built into the bow during manufacture, or retrofitted on existing crossbows. It provides a balanced draw quicker and permits uncocking quicker without damage to the bow or string, than presently existing crossbow cocking devices.

1 Claim, 10 Drawing Sheets

KWICK-COCK

REFERENCE TO PROVISIONAL APPLICATION

This application claims an invention disclosed in Provisional Application No. 60/510,583 filed Oct. 14, 2003, by Will Lee Crites, Jr. and John Blair Weiss; a crossbow cocking device entitled "KWICK-COCK". The benefit under 35 USC. of the United States provisional application, and the license for foreign filing under 35 USC. Sctn. 184, and 37 Code of Federal Regs, 5.11 and 5.15, is hereby claimed, and the aforementioned application is hereby incorporated herein by reference.

Inventors: Will Lee Crites, Jr., 14325 W. 89th St., Lenexa, Kans. 66215 John Blair Weiss, 23339 Victory Rd., Spring Hill Kans., 66083

| | |
|---|---|
| U.S. Class: | 124/25 |
| Field of Search: | 124/25 |

References Cited

| U.S. Patents | | | |
|---|---|---|---|
| 3,670,711 | June 1972 | Firestone | 124/25 |
| 3,739,765 | June 1973 | Moore | 124/25 |
| 4,258,689 | March 1981 | Barnett | 124/25 |
| 4,545,358 | October 1985 | Collins | 124/25 |
| 4,593,675 | June 1986 | Waiser | 124/25 |
| 4,594,994 | June 1986 | Williams | 124/25 |
| 4,603,676 | August 1986 | Luoma | 124/25 |
| 4,649,891 | March 1987 | Bozek | 124/25 |
| 4,649,892 | March 1987 | Bozek | 124/25 |
| 4,699,117 | October 1987 | Waiser | 124/25 |
| 4,719,897 | January 1988 | Gaudreau | 124/25 |
| 4,732,134 | March 1988 | Waiser | 124/25 |
| 4,766,874 | August 1998 | Nishioka | 124/25 |
| 4,796,598 | January 1989 | Jones | 124/25 |
| 4,827,894 | May 1989 | Schallberger | 124/25 |
| 4,879,987 | November 1989 | Nishioka | 124/25 |
| 4,917,071 | April 1990 | Bozek | 124/25 |
| 4,942,861 | July 1990 | Bozek | 124/25 |
| 5,115,795 | May 1992 | Farris | 124/25 |
| 5,220,906 | June 1993 | Choma | 124/25 |
| 5,243,956 | September 1993 | Luering | 124/25 |
| 5,522,373 | June 1996 | Barnett | 124/25 |
| 5,823,172 | October 1998 | Suggitt | 124/25 |
| 6,095,128 | August 2000 | Bednar | 124/25 |
| 6,286,496 | September 2001 | Bednar | 124/25 |
| 6,705,304 | March 2004 | Pauluhn | 124/25 |

BACKGROUND OF THE INVENTION

The history of the crossbow, dating back to medieval times, is well known. It allows the archer to draw the bowstring before actual need, reducing motion that could be observed by an enemy or game, and shooting the arrow more accurately by not having the muscles under stress when the arrow is released. A crossbow is also more compact and therefore more concealable than a longbow.

Crossbow bowstrings require extensive pulling pressure to place the bowstring at its most rearward position, i.e., the "cocked" position where the bowstring is held by the bowstring latch; preparing the bow to accept the arrow. These pulling pressures on many crossbows currently on the market are from 150 pounds, suitable for medium game, up to 200 pounds for very large or dangerous game.

This required cocking effort is much greater than that of a traditional longbow or a compound bow, which are typically from 40 to 80 pounds; and extremely difficult for most persons. The crossbows' greater cocking pressures result from the shorter bow arms, which must be stiffer in order to propel an arrow with comparable velocities to those produced by longbows.

This cocking effort is beyond the ability of many persons, and in the case of the heaver pull bows, beyond the ability of most persons. Even if the strength of the individual is adequate, repeated drawing of the bowstring can result in injury. Therefore, cocking devices for crossbows are a necessity for most persons and desirable for all.

This invention, named "QWICK-COCK", is a bowstring drawing device and related attach mechanisms. Although many cocking devices have been invented, most are complicated and time consuming to manufacture and operate. The exception is a rope device, simple, but of limited value, reducing the cocking effort by only about one-half.

Only two devices are commonly seen in sporting goods stores: rope and rotary. As mentioned above, the rope is of limited advantage, and the rotary is complicated compared to this invention, typically requiring 25 to 30 seconds to operate. This invention is simple and can be operated in 2 seconds or less. It places the center of the bowstring on the latch; a requirement for accuracy. Although existing devices generally also center the bowstring, much more time is required.

This invention permits fast uncocking. Uncocking is necessary because tension on the bow limbs cannot be maintained indefinitely without damage to the bow. Most bow warranties are usually voided by "dry-firing"; that is pulling the trigger without an arrow in place. If an arrow is not fired during a hunt, for example, most bow manufacturers recommend carrying a low quality arrow with a blunt point, called a fieldpoint, for firing into the ground or other backstop to uncock. This is usually not convenient, and under certain conditions, not safe. It also requires the archer to carry an extra arrow specifically for this purpose, and if he forgets, an expensive arrow must be sacrificed. Most existing cocking devices, and all presently available in stores, cannot be used to uncock. Some cocking devices that have been invented, but not commercially viable, do permit uncocking without damage to the bow, but require more time.

SUMMARY OF THE INVENTION

A dual lever pivoting below the bowstring latch, curved to provide a drawing pressure (back) on the bowstring, as the lever is moved first up and then back and down.

This dual lever is made of two levers, one on each side of the crossbow body, (or stock) and joined at the muzzle end of the bow by a handle. This handle is used by the archer to operate the cocking device.

If a straight lever was used, the first pressure would be primarily up, and would pull the bowstring up instead of back. By curving the lever, a backward pulling pressure is achieved, drawing the bowstring rearward to engage the bowstring latch.

By locating the pivot point of the lever below the bowstring latch, the leverage increases as the lever moves back; and the required pressure by the archer on the lever handle decreases as the backward pulling pressure on the bowstring increases.

The pivot points can be manufactured into the bow body. For existing bows, ways to provide these pivot points are included in this invention. These pivot points, whether installed at manufacture or afterward, are a part of this invention.

After cocking, the lever can be left on the bow for additional shots, or quickly removed as the shooter prefers.

BRIEF DESCRIPTION OF THE DRAWINGS

Orientation of the Crossbow Directions.

All directions are referenced to the crossbow when placed on a horizontal surface such as a table top. Up or top means above the crossbow or moving in that direction. Down or bottom means below the crossbow, or moving in that direction. Front means the arrowhead end of the crossbow; back means the shoulder stock end of the crossbow. Side means the view with the bow limbs in their least visible position.

DETAILED DESCRIPTION OF THE PREFERRED EMBODIMENTS

Figure 1:
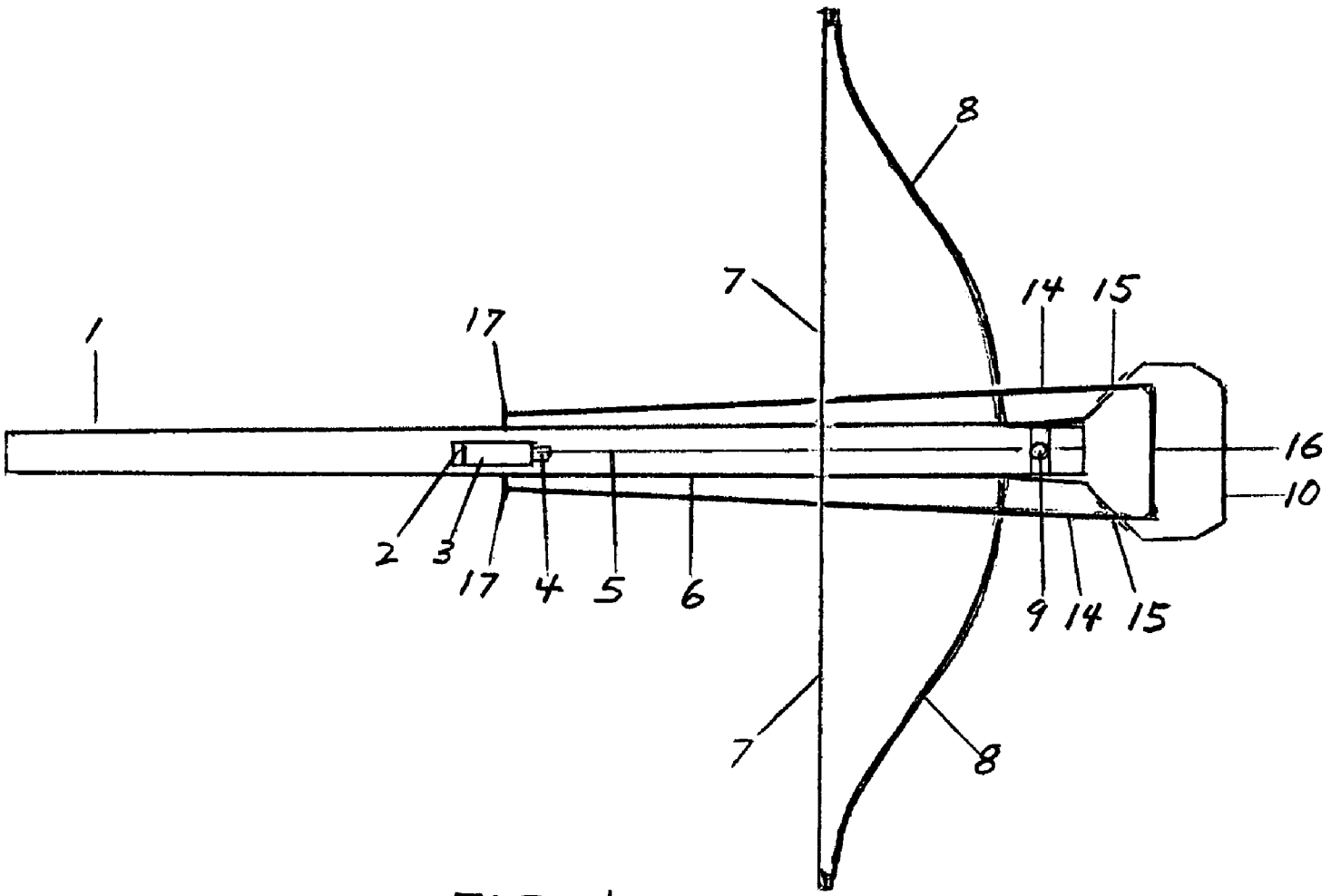
FIG. 1 is a top view of a crossbow with the cocking lever in the front position before cocking.

In the accompanying drawings, the number and description of the parts are common to all drawings FIG. 1 through FIG. 10, although all parts do not appear in all drawings. Parts numbered 1 through 13 and part 19 and 26 are parts of a typical crossbow without the invention. Parts numbered 14 through 18 and 20 through 27 pertain to the invention.

Figure 2:
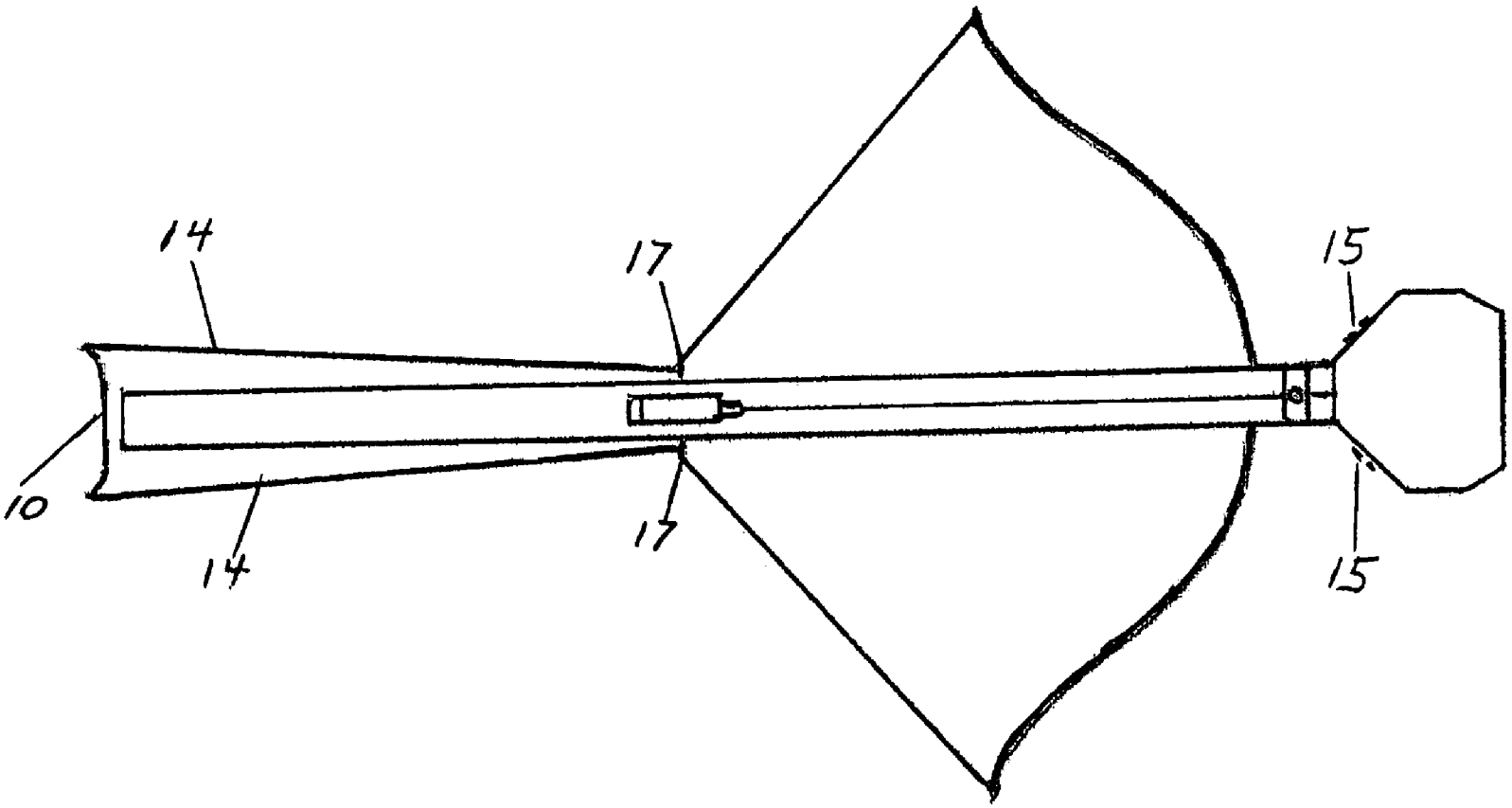
FIG. 2 is a top view with the cocking lever in the back position engaging the bowstring in the bowstring latch.
Figure 3:
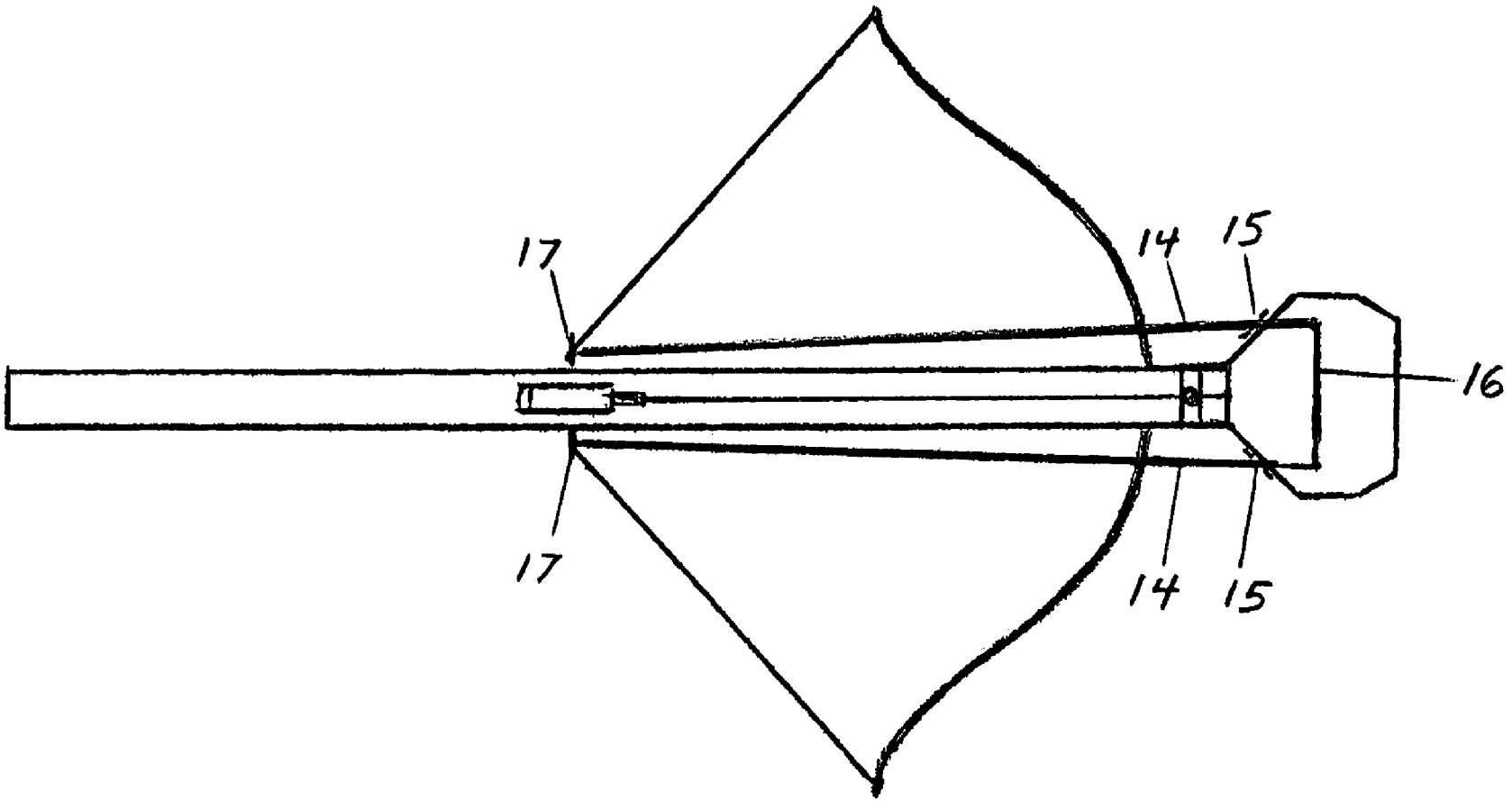
FIG. 3 is a top view with the cocking lever in the front position with the bow cocked and ready for firing.

FIGS. 1, 2, and 3 are top view drawings of the crossbow and invention.

Reference characters that pertain to the crossbow and the invention are shown in FIG. 1. To aid in clarity, references characters that pertain only the crossbow are not repeated in FIGS. 2 and 3, which show only the reference characters pertaining to the invention.

Figure 4:
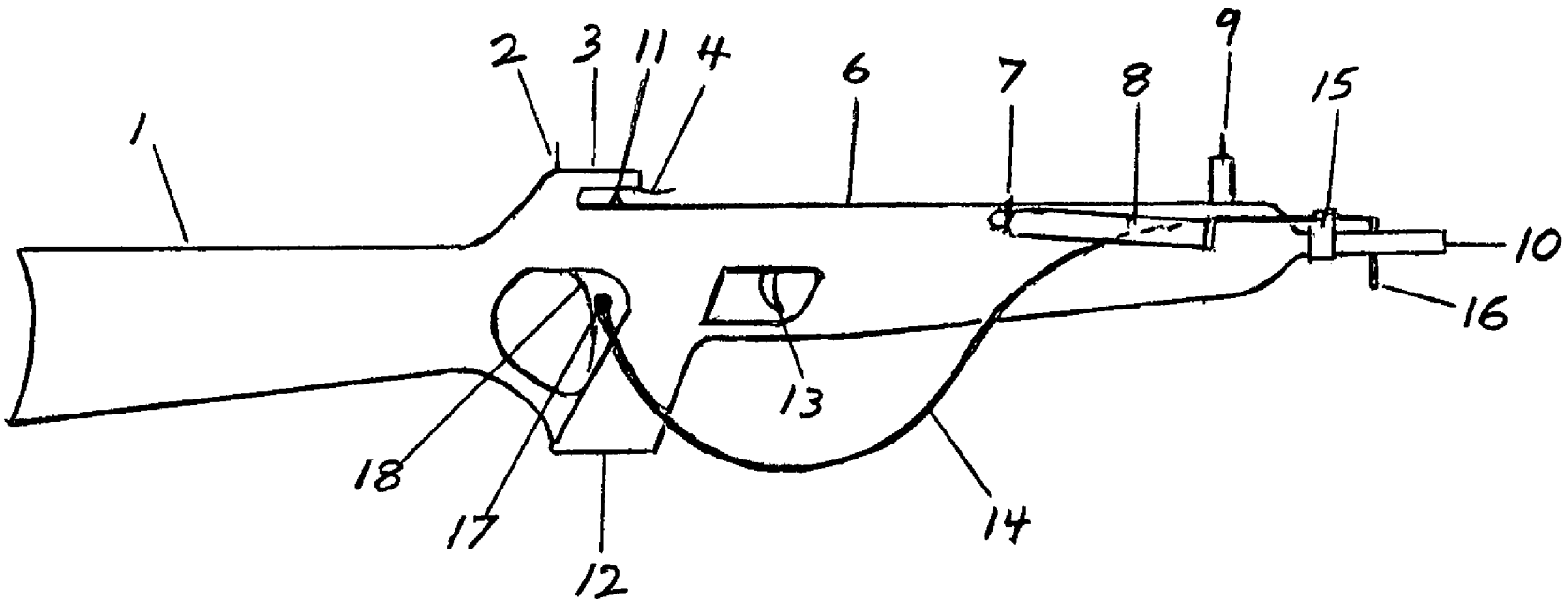
FIG. 4 is a side view of a crossbow with the cocking lever in the front position before cocking.
Figure 5:
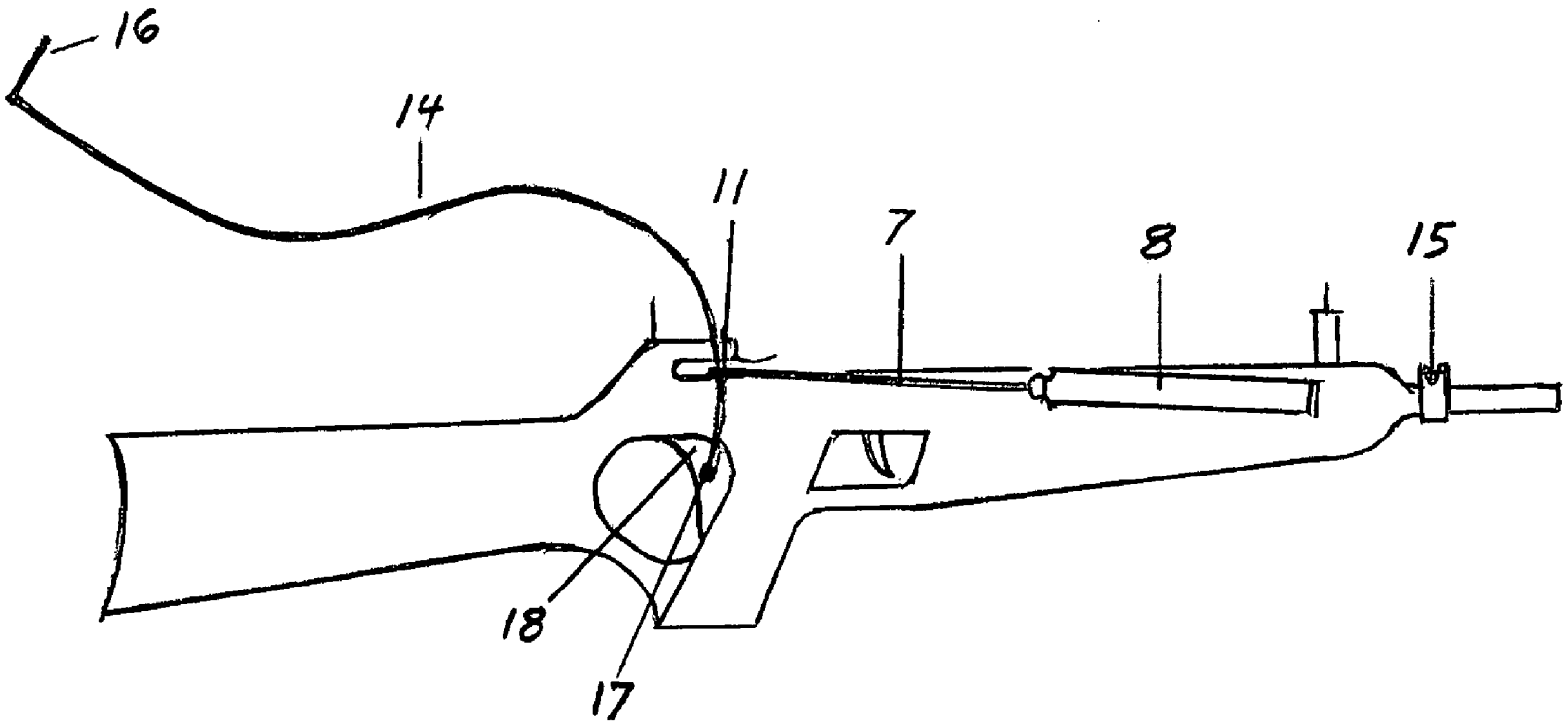
FIG. 5 is a side view with the cocking lever in the back position as the bowstring engages the bowstring latch.
Figure 6:
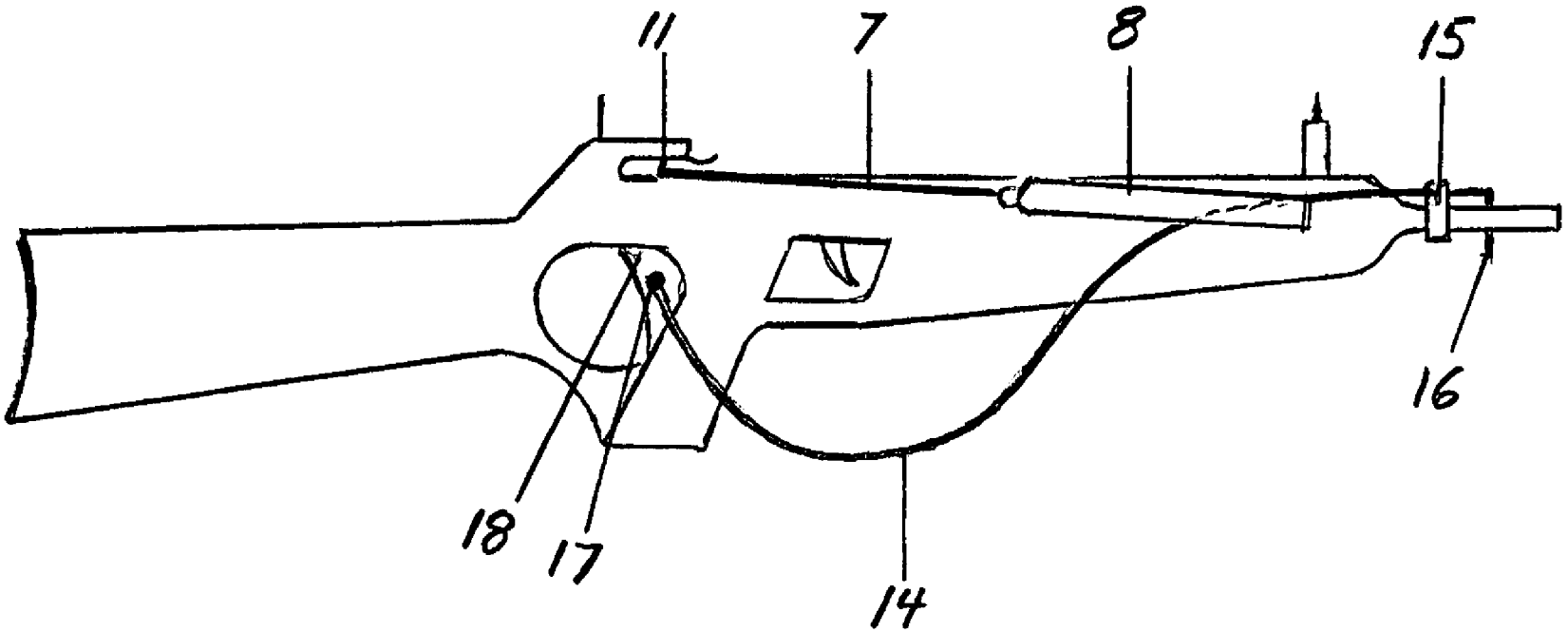
FIG. 6 is a side view with the cocking lever in the front position with the bow cocked and ready for firing.

FIGS. 4, 5, and 6 are side view drawings of the crossbow and invention.

Reference characters that pertain to the crossbow and the invention are shown in FIG. 4, To aid in clarity, references characters that pertain only to the crossbow are not repeated in FIGS. 5 and 6, which show only the reference characters pertaining to the invention.

Figure 7:
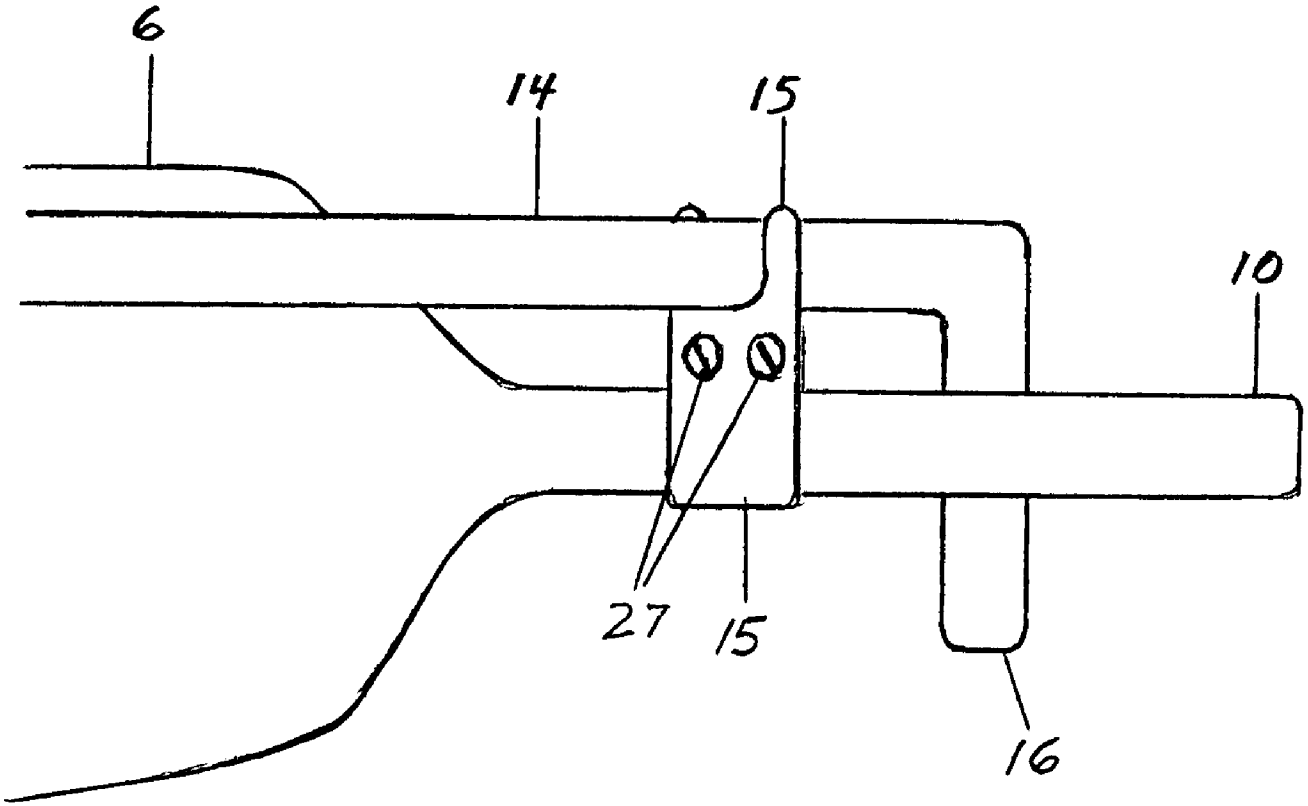
FIG. 7 is side view of the clamp holding the lever in the front position both before and after cocking.

FIG. 7 is a side view of the front end of a crossbow with the clamp (15) and the lever (14) in place, in the before cocking position, and also in the after cocking position.

Figure 8:
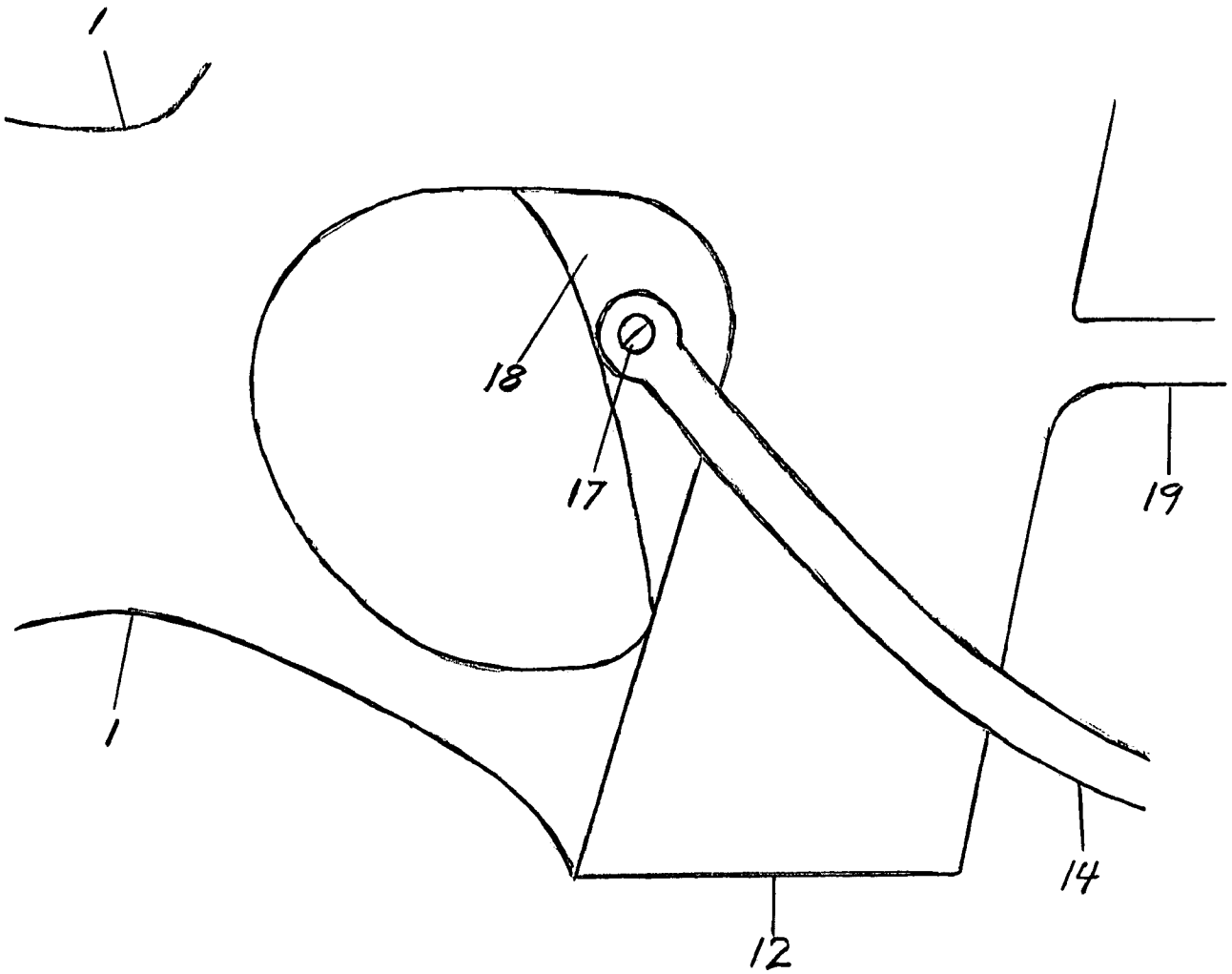
FIG. 8 is an enlarged side view of the pivot point attachment shown in FIGS. 4, 5, and 6, which shows bows where the trigger is below and in front of the bowstring latch. This pivot point attachment is used on bows which do not have a pivot point installed when the bow is manufactured.

FIG. 8 is a side view of the pivot bolt (17) on those crossbows that have the trigger (13) in front of the bowstring latch, FIGS. 4, 5 AND 6. showing the inlay (19) on the back side of the pistol grip (12); providing a pivot bolt support positioned below the bowstring latch (11). Bowstring latch (11), and the trigger (13), do not appear in FIG. 8; an expanded view focusing on the detail surrounding the pivot bolt (17).

Figure 9:
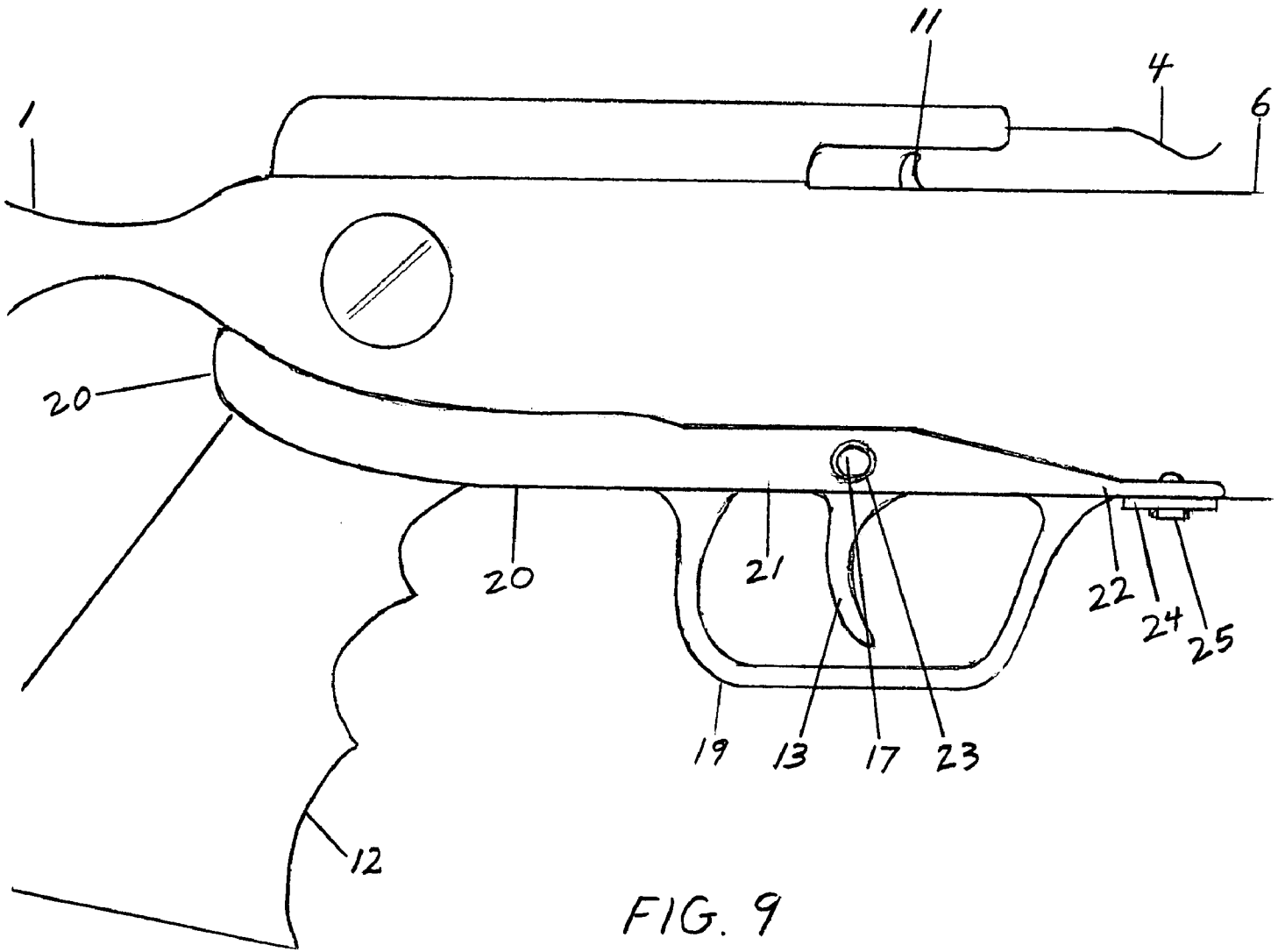
FIG. 9 is a side view of the pivot point attachment on those bows where the trigger is below the bowstring latch. This pivot point attachment is used on those bows which do not have a pivot point installed when the bow is manufactured.
Figure 10:
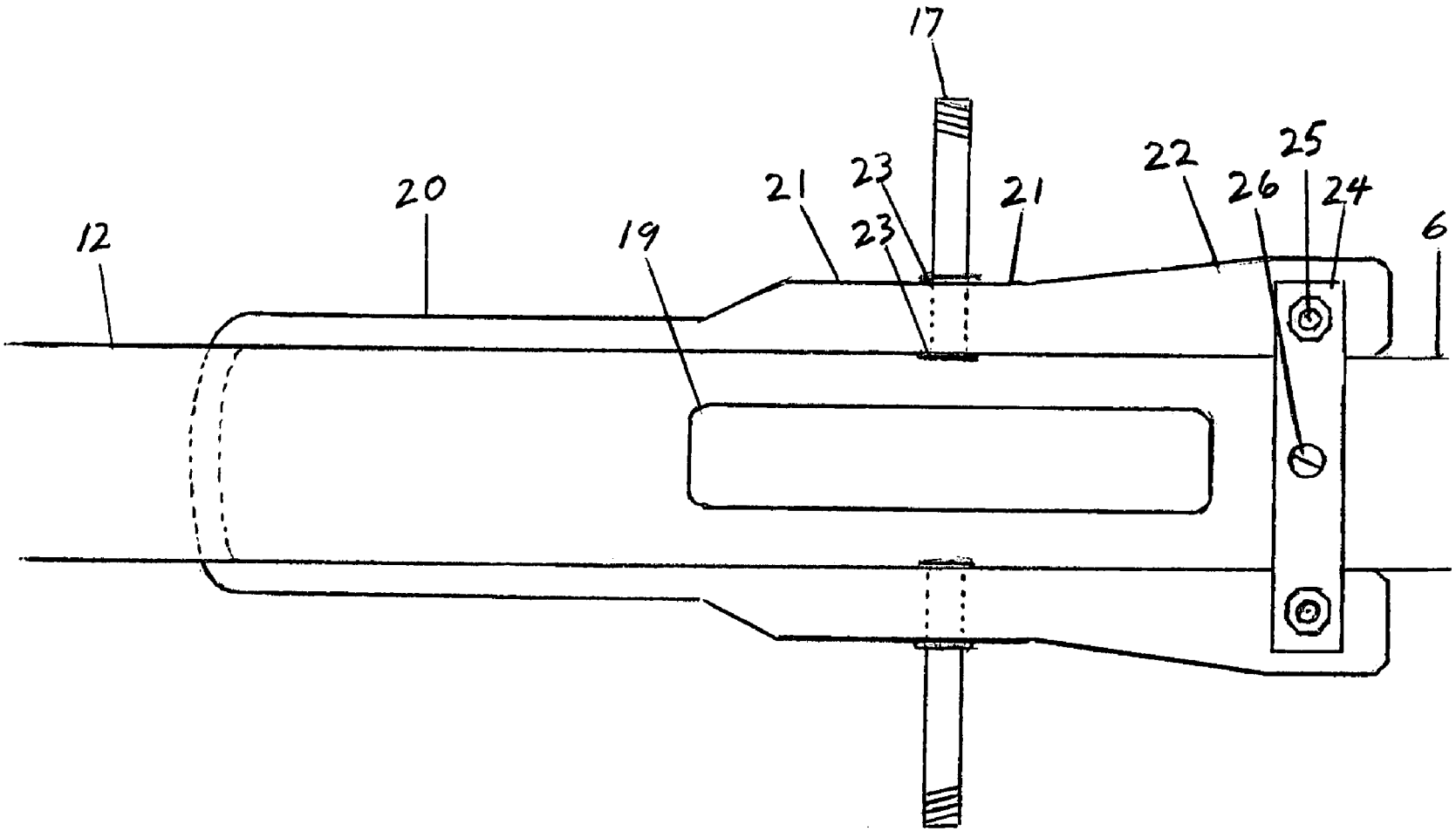
FIG. 10 is a bottom view of the pivot point attachment in FIG. 9.

FIGS. 9 and 10 are side and bottom views respectively, of a device to provide pivot bolts (17) on those crossbows in which the bowstring latch (11) is above the trigger (13).

The following part numbers are common to all drawings, although not all parts are visible in all drawings.

Part No.

1 Shoulder stock
2 Rear sight
3 Bowstring latch housing
4 Arrow hold
5 Arrow groove
6 Forearm
7 Bowstring
8 Bow limbs
9 Front sight
10 Stirrup
11 Bowstring latch
12 Pistol grip
13 Trigger
14 Lever
15 Lever clamps
16 Lever handle
17 Lever pivot bolt
18 Inlay (wood, plastic, or metal to provide support for pivot bolt)
19 Trigger housing
20 Steel tubing flattened vertically
21 Steel tubing left round
22 Steel tubing flattened horizontally
23 Weld
24 Plate. (to fasten front end of pivot mount to crossbow forearm)
25 Machine screw and nut
26 Forearm screw
27 Lever clamp screws.

Existing crossbows have several variations. but the primary differences pertain to: (A) The bowstring arrangement, and (B) the placement of the bowstring latch.

(A) The bowstring arrangements are primarily two: 1. A single string going from the far end of one bow limb to the far end of the other bow limb. 2. An interlacing string wound through cams on the ends of the bow limbs.

(B) The placement of the bowstring latch also has two basic categories: 1. The bowstring latch placed above and to the rear of the trigger, 2. The bowstring latch placed almost directly above the trigger.

This invention is applicable to these and other presently existing crossbows.

Referring to the following drawings, and to the above reference characters, part numbers, and part names, FIG. 1 is a top view of the crossbow with the curved levers (14) visible on either side of the forearm (6), the levers made into single unit by the lever handle (16) and hereinafter referred to in the singular, "lever". In this view, the lever (14) is in the front position and clamped by securing clamps (15) prior to drawing (cocking) the bowstring. FIG. 4 is a side view of this position of the lever.

All crossbows require lubricant to the forearm (6) and bowstring (7). In the present invention, lubricant is also applied to the lever (14), although not necessary before each use. To operate, the archer grasps the lever handle (16), and with a foot in the stirrup (10), and the other hand on the shoulder stock (1), pulls the lever up and then back towards the stock (1) until the bowstring (7) engages the bowstring latch (11), which is visible in FIGS. 4, 5 and 6 under the bowstring latch housing (3). It can also be operated with one hand on the stirrup (10) and the other on the lever handle (16) while resting the stock (1) on the archer's leg. This full draw or cocked situation is showed in FIG. 2, top view, and FIG. 5, side view.

After cocking, the lever (14) is returned to the forward position as shown in FIG. 3 and FIG. 6, with the bow limbs (8) bent under tension and the bowstring (7) in full draw (cocked) secured by the bowstring latch (11) and the lever (14) is secured by the lever clamps (15).

An arrow can now be placed in the arrow groove (5) with back portion of the arrow under the arrow hold (4) and is ready for release by pressing the trigger (13) which releases the bowstring latch (11).

FIGS. 1 and 4 are of the crossbow and invention top and side views before cocking.

FIGS. 2 and 5 are of the crossbow and invention top and side views during cocking.

FIGS. 3 and 6 are of the crossbow and invention top and side views after cocking.

The curved levers (14) are constructed of round steel tubing of sufficient hardness and diameter to withstand bending when in use. For crossbows with lighter pulling pressure, those up to 165 pounds, tubing of 5/16 inch OD (Outside Diameter) with a wall thickness of 0.049 inch. Chromium-molybdenum 4130 steel or a metal with a similar hardness rating should be used. For those crossbows with a pulling pressure of between 165 and 180 pounds, the same material tubing with an OD of 3/8 inch and 0.058 inch wall thickness; and for 180 pounds and heavier, the same material tubing with an OD of 7/16 inch and a wall thickness of 0.065 inch is adequate. Tubing with an OD (Outside Diameter), wall thickness, and metal rating other than the above will work, but could have disadvantages of optimal weight and rigidity of the lever (14).

The curvature of the lever (14) varies with the distance from the bowstring latch (11) to the bowstring (7) when the bowstring (7) is at rest before cocking. At the point where the lever (14) begins to exert pressure on the bowstring (7), the angle between the bowstring (7) and forearm (6) should be at least 50 degrees. This angle should increase as the lever (14) is moved upward and back and approach 90 degrees as it nears the bowstring latch (11), and pulls the bowstring (7) to the arrow hold (4) and engages the bowstring latch (11). The angles can vary somewhat without negating the function of the lever, but these are recommended angles.

The curve of the lever (14) can be made by use of a tube bender or a jig (form). Cold bending can be done on the lighter weight tubing, 5/16 inch OD (Outside Diameter) without collapsing the tubing wall, but heat application is necessary on the 3/8 and 7/16 inch OD tubing.

FIG. 7 is a side view of the clamp (15) holding the cocking lever (14) in place before and after cocking. On some crossbows, the length of the clamp (15) will have to be longer (higher) to accommodate lever (14) positions in the varying configurations of crossbows. Although only one clamp (15) is visible in FIG. 7, two are required as shown in FIGS. 1, 2, and 3, one for each side of the lever (14), and secured to both sides of the sturrup (10). This clamp (15) is constructed of one inch wide 4130 steel of 0.040 inch thickness, formed around the sides of the sturrup (10) drilled and filed to exert enough pressure on the lever (14) to hold it in place during recoil; and attached to the sturrup (10) with machine screws (27).

FIG. 8 is a side view enlargement of the area surrounding the inlay (18) supporting the pivot bolt (17) on those crossbows which have the bowstring latch (11) back of the trigger (13). The ends of the lever (11) on both sides of the inlay (18) are flattened, rounded and drilled to accept the pivot bolt (17). The bowstring latch (11) and the trigger (13) are outside the scope of FIG. 8. The inlay (18) can be constructed of any material to provide a bearing surface for the pivot bolt (17), and fastened to the back of the pistol grip (12) and to the area of the shoulder stock (1) as shown with an adhesive appropriate to the material. Suitable materials for the inlay (18) are hardwood, plastic or metal. The inlay (18) is used on crossbows that do not have a pivot bolt installed during the manufacture of the crossbow. The pivot bolt (17) is in one piece and goes through the inlay (18). This pivot bolt (17) is of 8740 alloy steel and 3/16 inch, although other bolts would also perform satisfactorily. This pivot bolt (17) can have a head on one end and a nut on the other, or can have a quick release nut on both ends for quick removal of the lever (14) if the archer desires, or left in place for multiple shots.

FIG. 9 is a side view, and FIG. 10 is bottom view, of a device to provide a pivot bolt (17) on those crossbows that have the trigger (13) below the bowstring latch (11). This places the pivot bolt (17) below and slightly in back of the bowstring latch (11). This device is constructed from round steel tubing, /5;16 inch OD (Outside Diameter), wall thickness 0.049 inch of 4130 chromium-molybdenum steel, or a metal with a similar hardness rating. Larger OD tubing, and a larger wall thickness will also work, but has more bulk and weight than is needed. The 5/16 inch tubing provides adequate support for the pivot bolts, one on each side of the forearm (6), and the welds (23) attaching the pivot bolts (17) to the steel tubing (21).

The steel tubing is flattened vertically (20) around the pistol grip, left in its original round shape (21) around the pivot bolts (17), and flattened horizontally (22) at the front end where it is attached to the plate (24), by use of a machine screw and nut (25). The plate (24) is secured to the forearm (6) by a screw (26). On those crossbows having this screw (26) as part of the original manufacture, as many do, the screw (26) can be removed and then reinserted through the plate (24) securing the plate to the forearm (6). Since the pivot bolts (17) do not go through the forearm (6), but only through the tubing (21), welds on both sides of the tubing (21) are necessary to provide strength to withstand cocking pressures. Most readily available bolts (17) are satisfactory, but those bolts made of 4037 or 8740 alloy steel are preferred. Bolts of 3/16 inch diameter are adequate.

This description of the preferred embodiments is in detail, however it should be understood that reference to these details is not intended to limit the scope of this invention, but are illustrative of the application of the principles of this invention as described in Claims section of this application.

Note: FIG. 4 is suggested as the view to be included on the front page of the patent application publication and patent.

What is claimed is:

1. A force multiplying cocking device operable on crossbows with a main structural member consisting of a shoulder stock and a forearm, with an row groove on the top of and extending longitudinally on said forearm, with bow limbs positioned transversely on said forearm and fastened rigidly thereto while allowing flex of the said bow limbs from the fastening point on said forearm to the outer tips of the said bow limbs, a bowstring crossing on top of said forearm and said arrow groove, said bowstring attached to the outer tips of said bow limbs, said bowstring of adequate strength to withstand repeated force generated by the flexing of said limbs, a bowstring securing means extending upward through the main structural member and centered on and at the rear of the said arrow groove to hold the said bowstring in the maximum draw or full cock position, a mechanism to enable the release of said securing means, said release mechanism activated by, or an integral part of, a trigger pivoting within and extending below said main structural member within access to the operator's finger, with said force multiplying cocking device consisting of a curved lever made of material of sufficient hardness to repeatedly withstand the force exerted to move the bowstring to its most rearward or full cock position, said curved lever mounted on a pivot pin located below and toward the rear of the row groove, said curved lever having an arm on each side of the forearm providing equal force against the bowstring on both sides of the forearm and centering the bowstring on the arrow groove, said curved lever having a smooth surface to avoid damage to bowstring when sliding along curved lever, said curved lever arms joined at the end opposite said pivot pin by a lever positioned wider said bowstring, and curving above the top of the forearm and extending past the front end of said arrow groove when said curved lever is in the rest position before and alter cocking said bowstring, said lever handle shaped to be clear of the path of the arrow when said lever is in the rest position before and after cocking; a clamp on either side of the forearm for holding the said lever in the rest position, said clamps consisting of flat spring material with an opening slightly smaller than the diameter of said lever arms, said clamps fastened to the from and on either side of said forearm, and gripping said lever arms after downward pressure on said lever handle, degree of curve of said lever to provide primarily a rearward force instead of an upward force on the bowstring as the lever handle is moved up and toward the rear of the forearm, the pressure on said bowstring progressively increases as the leverage also progressively increases at a faster rate, thereby reducing the applied force on said lever handle needed to draw said bowstring rearward, and as the bowstring nears the bowstring securing means, the required cocking force on said bowstring is at its greatest, the leverage is also at its greatest, and the necessary applied force on said lever handle is at its lowest.

* * * * *